US005116205A

United States Patent [19]

Kirchhofer

[11] Patent Number: 5,116,205

[45] Date of Patent: May 26, 1992

[54] PRESSURE EXCHANGER FOR INTERNAL-COMBUSTION ENGINES

[75] Inventor: Hubert Kirchhofer, Untersiggenthal, Switzerland

[73] Assignee: Asea Brown Boveri Ltd., Baden, Switzerland

[21] Appl. No.: 619,444

[22] Filed: Nov. 29, 1990

[30] Foreign Application Priority Data

Dec. 6, 1989 [CH] Switzerland ..... 4375/89-0

[51] Int. Cl.[5] ..... F04B 21/00

[52] U.S. Cl. ..... 417/64; 60/39.45

[58] Field of Search ..... 417/64; 60/39.45 A, 60/39.45 R

[56] References Cited

U.S. PATENT DOCUMENTS 3,055,577 9/1962 Vickery ..... 416/64
4,123,200 10/1978 Hörler et al. ..... 417/64

FOREIGN PATENT DOCUMENTS 443643 of 1942 Belgium .
550937 6/1974 Switzerland .
21331 of 1912 United Kingdom ..... 417/64
2373 of 1913 United Kingdom ..... 417/64
959721 6/1964 United Kingdom .
1126705 9/1968 United Kingdom .

*Primary Examiner*—Richard A. Bertsch
*Assistant Examiner*—Charles Freay
*Attorney, Agent, or Firm*—Burns, Doane, Swecker & Mathis

[57] ABSTRACT

This pressure exchanger has an at least single-series cellular wheel arranged on a central axis and equipped with cells. These cells interact in a specific time sequence on the one hand with a hot-gas guide housing and on the other hand with an air guide housing. A pressure enchanger having an increased flushing energy is to be provided. This is achieved in that the cells each have a longitudinal axis which intersects the central axis at an angle. Moreover, the faces of the hot-gas guide housing and air guide housing confronting the cellular wheel extend parallel to the corresponding faces of the cellular wheel.

10 Claims, 2 Drawing Sheets

PRESSURE EXCHANGER FOR INTERNAL-COMBUSTION ENGINES

BACKGROUND OF THE INVENTION

1. Field of the Invention

The present invention starts from a pressure exchanger for internal-combustion engines, with a central axis and with an at least single-series cellular wheel which is arranged on this central axle and is equipped with cells and the cells of which interact in a specific time sequence on the one hand with channels in a hot-gas guide housing and on the other hand with channels in an air guide housing.

2. Discussion of Background

A pressure exchanger is known from Patent Specification CH-550,937. The cellular wheel interacts with an air guide housing and with a hot-gas guide housing. In the cells the sucked-in air is compressed in a known way and is then diverted by means of high-pressure air channels of the air guide housing into a combustion chamber of an internal-combustion engine. As is known, the hot gases which were used for the pressure exchange flow off from the cells of the cellular wheel and further through channels in the hot-gas guide housing into a gas turbine. At the same time, fresh air is sucked in and fills the corresponding cells of the cellular wheel up again. This operation of pressure exchange can take place in a known way either by a reversal process or by a throughflow process.

At comparatively high speeds of the cellular wheel, it can happen that the flow-off of the hot gases from the cells of the cellular wheel is impeded because of insufficient flushing energy, the result of which is that too little fresh air also flows after them into the cells. In the separating zone between the fresh air and hot gases, the two components are intermixed in the cells, with the result that too little clean fresh air subsequently enters the internal-combustion engine, thereby reducing its efficiency. Both the cellular wheel and the housings have to be manufactured with comparatively high precision, since only then can a sufficiently small play between the cellular wheel and the housings be obtained. A reduction of the play in order thereby to increase the efficiency of the pressure exchanger necessitates check measurements involving a high outlay and mechanical reworking of the components, thus making production more expensive.

SUMMARY OF THE INVENTION

Accordingly, one object of this invention is to provide a novel pressure exchanger with increased flushing energy. The invention, as defined in the claims, achieves this object.

The advantages afforded by the invention are to be seen essentially in that forces occurring during the operation of the pressure exchanger can be utilized in order to improve its operating behavior and its efficiency. The mounting of the cellular wheel is substantially simplified and speeded up. The efficiency of the pressure exchanger can be increased by simple means.

The further embodiments of the invention are the subjects of the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DESCRIPTION OF THE PREFERRED EMBODIMENTS

Figure 1:
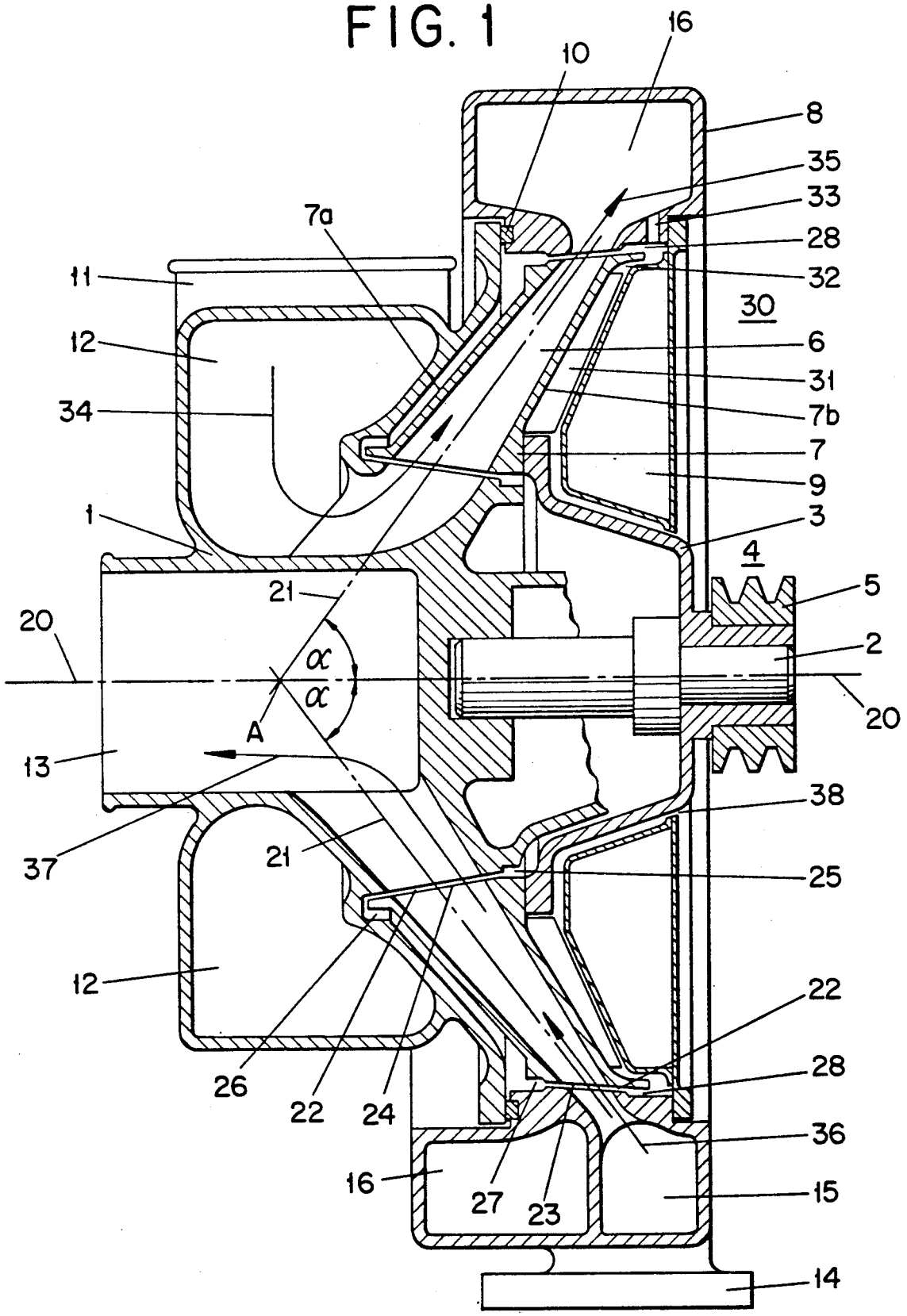
FIG. 1 shows a simplified basic diagram of a first embodiment of a pressure exchanger.

Referring now to the drawings, wherein like reference numerals designate identical or corresponding parts throughout the several views, FIG. 1 shows a section through this pressure exchanger, without showing obviously present mountings and connecting lines to an internal-combustion engine, to an air filter and to an exhaust. An air guide housing 1 carries a journal 2, on which a carrier flange 3 designed as a hub of a multipart cellular wheel 4 is mounted rotatably. The carrier flange 3 is on the one hand connected rigidly to a belt pulley designed for receiving V-belts and on the other hand screwed to a part 7 of the cellular wheel 4 containing cells 6. The part 7 is connected operatively to the air guide housing 1 and to a hot-gas guide housing 8 which surrounds the part 7 externally and which is connected rigidly to the air guide housing 1. Accordingly, in conjunction with the air guide housing 1, the hot-gas guide housing 8 separates one end face 7*a* and the outer face of the cellular wheel 4 from the environment, whilst the other end face 7*b* is shielded from the environment by a cover 9. Between the air guide housing 1 and the hot-gas guide housing 8 there is a thermal insulation 10 which can consist, for example, of a zirconium oxide ring.

The air guide housing 1 has a suction connection 11 guiding fresh air sucked in by the air filter (not shown) into an annular channel 12 which distributes it to the cells 6. Furthermore, the air guide housing 1 has a channel 13 which collects the compressed fresh air coming out of the cells 6 and which conveys it to a combustion chamber (not shown) of the internal-combustion engine. Hot exhaust gas coming out of the internal-combustion engine passes through a connection piece 14 into a channel 15 of the hot-gas guide housing 8 and from there into the cells 6. A further channel 16 collects exhaust gases flushed out of the cells 6 and conveys it into an exhaust (not shown).

The pressure exchanger has a central axis 20 about which the cellular wheel 4 rotates. In the Figure, the cellular wheel 4 has only one series of cells 6. It is perfectly possible, however, to design the cellular wheel 4 with two or more series of cells 6. The cells 6 each have a longitudinal axis 21. All the longitudinal axes 21 of a cell series meet at a point A of the central axis 20 at the same angle $\alpha$ relative to this. The angle $\alpha$ is advantageously in a range of approximately 15° to 90°. If the cellular wheel 4 is equipped with two or more series of cells 6, then as a rule the longitudinal axes 21 of the cells 6 of the second and further series form the same angle $\alpha$ with the central axis 20. It is also possible, however, for the longitudinal axes of the second and further series each to form with the central axis 20 angles different from that of the first series.

The cells 6 extending along their longitudinal axes 21 have as a rule the same cross-section over their entire length, but it is also possible for these cell cross-sections to have narrowings and/or widenings. In FIG. 1, the cells 6 taper continuously outwards, but the cell cross-sections remain the same. The walls of the cells 6 are of streamlined form, as are the respective inflow and flow-off channels for hot gases and fresh air.

The part 7 of the cellular wheel 4 is fitted exactly between the hot-gas guide housing 8 and air guide housing 1, so that only minimal gaps 22 are formed. A face 23 of the part 7 of the cellular wheel 4 confronting the hot-gas guide housing 8 is designed as an annular segment of the generated surface of a first cone, the apex of this first cone being located to the left of the cellular wheel 4 on the central axis 20. The face of the hot-gas guide housing 8 located opposite this face 23 is made correspondingly conical and extends parallel to this. A face 24 of the part 7 confronting the air guide housing 1 is designed as an annular segment of the generated surface of a second cone, the apex of this second cone being located to the right of the cellular wheel 4 on the central axis 20. The face of the air guide housing 1 located opposite this face 24 is made correspondingly conical and extends parallel to this. The apices of the respective mutually associated cones are offset in proportion to the respective gap width on the central axis 20.

Gas can escape through the gaps 22. Between the air guide housing 1 and the part 7 there are annular chambers 25, 26, into which can be inserted a sealing medium which in a known way prevents a gas loss from occurring on this side of the cellular wheel 4. The sealing medium must be temperature-resistant. Between the hot-gas guide housing and the part 7 there are annular chambers 27, 28, into which a sealing medium can be inserted for the purpose of preventing gas losses. The sealing medium must be resistant to high temperature here. Examples of a possible sealing medium are piston rings made of various materials or labyrinth gaskets.

If a separate sealing, as described above, of the cellular wheel 4 is forgone or if gas losses still occur despite the sealing, these can be diverted into the channel 16 and from there into the exhaust by means of a leakage-gas pumping device 30. In FIG. 1, the leakage-gas pumping device 30 is provided only on that side of the part 7 of the cellular wheel 4 facing away from the air guide housing 1, but it can also be provided on the two end faces *7a* and *7b* of the cellular wheel 4. Formed on the part 7 are blades 31 which extend radially and which cover virtually the entire free cross-section between the part 7 and the cover 9. A comparatively small annular gap 38 remains open between the carrier flange 3 and the cover 9, to allow an afterflow of outside air. Adjacent to the outer ends of the blades 31 there is provided an annular volume 32 which opens into the chamber 28. From the chamber 28, connecting ports 33 distributed on the circumference lead into the channel 16 which is connected to the exhaust.

The cover 9 limits the volume swept by the blades 31. Moreover, the cover 9 serves as noise and thermal insulation and is therefore designed so that it cannot experience intrinsic vibrations.

The cellular wheel 4 can rotate freely or under power, depending on the type of pressure exchanger, but it is also possible for it to be power-driven only during the starting phase and/or in the part-load mode and for it to run by itself thereafter. The rotational speed is coordinated with the particular operating state of the internal-combustion engine.

The operating mode of this pressure exchanger will be explained briefly with reference to FIG. 1. As indicated by an arrow 34, fresh air flows through the air guide housing 1 into the pressure exchanger and further into a cell 6 of the cellular wheel 4. As a rule, two or more cells 6 are filled simultaneously with fresh air from the annular channel 12. There can also be various series of these cells in a cellular wheel 4. As indicated by an arrow 35, the inflowing fresh air flushes exhaust gases out into the channel 16, from where they pass into the exhaust. Since the cellular wheel 4 rotates at a comparatively high speed, the centrifugal forces act both on the fresh air and on the exhaust gases in the cell 6 and effectively assist the flushing-out operation. The smaller the angle A is selected, the smaller the outside diameter of the cellular wheel can be selected for a predetermined cell length. As indicated by an arrow 36, the fresh air flowing into the cell 6 is subjected to hot pressurized exhaust gas from the channel 15, energy being transmitted to the fresh air by means of pressure waves, the result of this being that the fresh air is compressed and accelerated radially inwards counter to the centrifugal force. The compressed fresh air then flows out of the cell 6 into the channel 13, as indicated by an arrow 37.

The mechanism of the energy exchange described is known and need not be described further here. Also, the boundary conditions for fixing the rotational speed of the cellular wheel 4 and the length of the cells 6 are known or can be derived from known axially designed pressure exchangers. In addition to the reversal process described here, however, it is also possible to carry out the pressure exchange in a throughflow process. It may also be mentioned here that the hot-gas guide housing 8 is shown rotated, so that the paths of the exhaust gases and of the fresh air can be illustrated clearly.

It is possible not to arrange the longitudinal axes of the cells in one plane in each case with the central axis 20, thereby increasing the energy for the natural rotation of the cellular wheel 4. Furthermore, in this version it is possible to make the cells longer for given dimensions of the cellular wheel 4 and thereby to increase the efficiency of the pressure exchanger.

An especially advantageous effect is obtained in that the part 7 is designed as a ring of wedge-shaped cross-section. Despite the narrow installation tolerances required, this makes it possible to obtain a rapid and safe mounting of the cellular wheel 4. It is even conceivable that thermal expansions in the turbine can be compensated by means of axial displacements of the cellular wheel 4 in both directions. Especially where larger pressure exchangers are concerned, a temperature-dependent control of the engagement of the cellular wheel 4 between the hot-gas housing 8 and the air guide housing 1 would necessarily occur, in order thus to keep the leakage losses in the gaps 22 small and thereby decisively increase the efficiency of the pressure exchanger.

The hot-gas guide housing 8 is located further away from the central axis 20 than the remaining parts of the pressure exchanger, so that it can expand outwards when it is heated. It surrounds the part 7 of the cellular wheel 4 annularly on the outside.

Leakage gas entering the volume between the blades 31 is prevented by the leakage-gas pumping device 30 from flowing out in an uncontrolled manner. The leakage gas is carried along by the blades 31 and accelerated, so that it quickly passes outwards into the volume 32 as a result of the centrifugal force acting on it. This flow becomes easier if air can flow after it from outside through the annular gap 38 between the carrier flange 3 and cover 9. The leakage gas flows from the volume 32 further through the chamber 28 and the connecting ports 33 into the channel 16 and from there, together with the remaining exhaust gases, into the exhaust. Along this path there can also be provided an exhaust-gas purification means by which the leakage gas is likewise purified.

The running noises of the cellular wheel 4 which are particularly intensive when a leakage-gas pumping device 30 is provided are advantageously reduced by means of the cover 9. Furthermore, the cover 9 prevents an uneven cooling of the part 7 of the cellular wheel 4 and associated internal stresses in the part 7.

The faces 23 and 24 of the cellular wheel 4 are respectively designed as annular segments of the generated surfaces of cones. The aperture angle of these cones is advantageously in the range of 10° to 25° by reason of construction. For mounting purposes and for the setting of the gaps 22, it seems expedient to select identical aperture angles for the two cones. For example, if an aperture angle of 16° is selected, a displacement of the cellular wheel 4 of 0.5 mm in the direction of the central axis 20 results in a compensation of the play in the gaps 22 of 7/100 mm. Technically expedient play-compensating possibilities are afforded precisely in this annular range around 16°. It is also possible, however, for the two cones to have different aperture angles, should the particular temperature conditions so require. The displacement of the cellular wheel 4 can take place by means of a controlled mounting, and the control can be carried out via sensors dependently of temperature or in dependence on the thickness of the gaps 22. A combination of the two types of control is also possible. Moreover, the gap setting can be carried out during the mounting of the turbine by means of shims between the shaft 2 and cellular wheel 4. However, in this latter instance subsequent gap changes require a dismantling of the machine.

Figure 2:
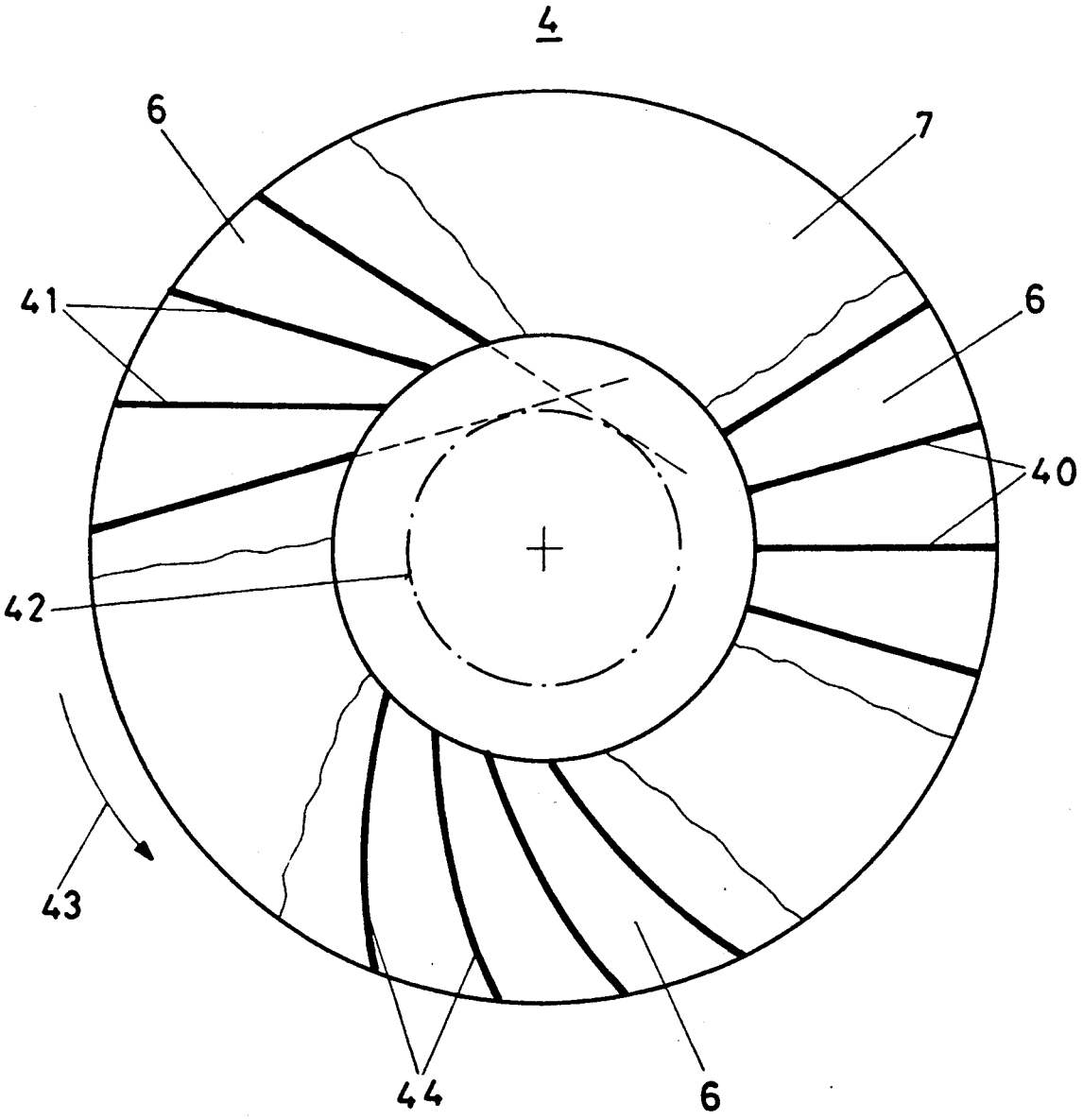
FIG. 2 shows various designs of a cellular wheel.

FIG. 2 shows the basic diagram of a cellular wheel 4 projected in a plane perpendicular to the central axis 20. Various designs of cells 6 are shown, although these do not usually occur in the same cellular wheel 4. Cell walls 40 extended radially in relation to the center of the cellular wheel 4 are possible. Furthermore, tangentially extending cell walls 41 are possible, the cell walls 41 being, as indicated, tangential to a circle 42 which has a smaller diameter than the carrier flange 3 of the cellular wheel 4. The diameter of this circle 42 is selected in accordance with the operating requirements demanded of the pressure exchanger. An arrow 43 indicates the direction of rotation of the cellular wheel 4. Cell walls 44 curved in this direction of rotation are likewise possible, as can be seen from FIG. 2. The cells 6 can be uniformly distributed respectively on the circumference of the cellular wheel 4, but in order to reduce the incidence of noise it is also possible to arrange the cells 6 irregularly or partly irregularly.

If the cellular wheel 4 is designed so that the faces 23 and 24 each take the form of annular segment of the generated surface of a cylinder, a further constructionally simpler version of the pressure exchanger is obtained. Especially when cooled media are used for the pressure-exchange process, as occurs, for example, in air-conditioning systems, this version of the pressure exchanger is particularly expedient. The two cylinders have a common center axis which coincides with the central axis 20, so that the gaps 22 extend parallel to this. Those faces of the hot-gas guide housing 8 and air guide housing 1 which confront the cellular wheel 4 are matched to the respective opposite faces 23 and 24, that is to say they are also designed as parts of cylinder surfaces. The remaining design of the pressure exchanger corresponds to that of FIG. 1, where the operating mode is also described.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. A pressure exchanger for internal combustion engines, with a central axis (20), with an at least single-series cellular wheel (4) which is arranged on this central axis (20) and is equipped with cells (6) and the cells (6) of which interact in a specific time sequence on the one hand with channels (15, 16) in a hot-gas guide housing (8) and on the other hand with channels in an air guide housing (1), wherein the cells (6) each have a longitudinal axis which intersects the central axis (20) at an angel ($\alpha$), wherein a face (23) of the cellular wheel (4) confronting the hot-gas guide housing (8) is designed as an annular segment of the generated surface of a first cylinder, wherein a face (24) of the cellular wheel (4) confronting the air guide housing (1) is designed as an annular segment of the generated surface of a second cylinder, wherein the first and second cylinders have the central axis (20) as a common axis, and wherein the faces of the hot-gas guide housing (8) and air guide housing (1) confronting the cellular wheel (4) extend parallel to the corresponding faces (23, 24) of the cellular wheel (4).

2. A pressure exchanger for internal combustion engines, with a central axis (20), with an at least single-series cellular wheel (4) which is arranged on this central axis (20) and is equipped with cells (6) and the cells (6) of which interact in a specific time sequence on the one hand with channels (15, 16) in a hot-gas guide housing (8) and on the other hand with channels in an air guide housing (1), wherein the cells (6) each have a longitudinal axis which intersects the central axis (20) at an angle ($\alpha$), wherein a face (23) of the cellular wheel (4) confronting the hot-gas guide housing (8) is designed as an annular segment of the generated surface of a first cone, wherein a face (24) of the cellular wheel (4) confronting the air guide housing (1) is designed as an annular segment of the generated surface of a second cone, wherein both the apex of the first cone and the apex of the second cone are located on the central axis (20), wherein one of the apices of the two cones is located respectively on each side of the cellular wheel (4), and wherein the faces of the hot-gas guide housing (8) and air guide housing (1) confronting the cellular wheel (4) extend parallel to the corresponding faces (23, 24) of the cellular wheel (4).

3. The pressure exchanger as claimed in Claim 1, wherein the hot-gas guide housing (8) surrounds the part (7) of the cellular wheel (4) annularly on the outside.

4. The pressure exchanger as claimed in Claim 1, wherein at least one end face (7b) of the cellular wheel (4) is equipped with a leakage-gas pumping device (30) which has essentially radially extending blades (31) formed on the at least one outer face of the cellular wheel (4), and at least one connecting port (33) to an exhaust channel (16) of the hot-gas guide housing (8).

5. The pressure exchanger as claimed in Claim 1, wherein a noise and thermal insulation designed as a cover (9) is provided in the region of the cellular wheel (4).

6. The pressure exchanger as claimed in Claim 1, wherein the cellular wheel (4) is designed to be free-running or power-driven or power-driven only during the starting phase.

7. The pressure exchanger as claimed in Claim 1, wherein the cells (6) have cell walls which are designed extended radially or extended in the tangential direction or curved in the direction of a rotational movement of the cellular wheel (4).

8. The pressure exchanger as claimed in Claim 1, wherein the longitudinal axes (21) of all the cells (6) respectively form the same angle ($\alpha$) with the central axis (20), and wherein this angle ($\alpha$) is in a range of approximately 15° to 90°.

9. The pressure exchanger as claimed in claim 2, wherein the first cone and the second cone each have an identical or a different aperture angle.

10. The pressure exchanger as claimed in claim 9, wherein the aperture angle is the range of 10° to 25°, but especially amounts to 16°.

* * * * *